US005975282A

United States Patent [19]

Shaver et al.

[11] Patent Number: 5,975,282

[45] Date of Patent: Nov. 2, 1999

[54] METHOD AND APPARATUS FOR STORING AND DISPENSING THIN FLEXIBLE OBJECTS

[75] Inventors: Robert L. Shaver, Brighton; Alfred J. Kafka, Wixom; Deepak Devnani, Farmington; Matthew C. Carey, Holt, all of Mich.

[73] Assignee: Jervis B. Webb Company, Farmington Hills, Mich.

[21] Appl. No.: 08/947,151

[22] Filed: Oct. 8, 1997

Related U.S. Application Data

[63] Continuation-in-part of application No. 08/781,808, Jan. 10, 1997

[60] Provisional application No. 60/009,943, Jan. 16, 1996.

[51] Int. Cl.[6] ..... B65G 15/44; B65G 32/00

[52] U.S. Cl. ..... 198/603; 198/604

[58] Field of Search ..... 198/347.3, 603, 198/604, 607; 414/390, 398, 416, 523

[56] References Cited

U.S. PATENT DOCUMENTS

| | | | |
|---|---|---|---|
| 1,998,912 | 4/1935 | Troy | 34/12 X |
| 4,078,648 | 3/1978 | Hinchcliffe et al. . | |
| 4,201,507 | 5/1980 | Hinchcliffe et al. | 414/331 X |
| 4,569,488 | 2/1986 | Baltisberger . | |
| 4,712,964 | 12/1987 | van Elten et al. . | |
| 4,872,543 | 10/1989 | Hinchcliffe . | |
| 5,018,618 | 5/1991 | Sjögren . | |
| 5,094,443 | 3/1992 | Young, Jr. . | |
| 5,121,825 | 6/1992 | Sjögren . | |
| 5,181,820 | 1/1993 | Sjögren et al. . | |
| 5,437,537 | 8/1995 | Sweet et al. . | |

FOREIGN PATENT DOCUMENTS

| | | |
|---|---|---|
| 3831475 A1 | 9/1988 | Germany . |

*Primary Examiner*—William E. Terrell
*Assistant Examiner*—Kenneth Bower
*Attorney, Agent, or Firm*—Dickinson Wright PLLC

[57] ABSTRACT

A device is disclosed for storing a stream of a plurality of thin flexible objects, such as newspapers or similar printed materials, which is constructed from a number of generally parallel conveyor sections arranged in a number of vertical columns. The conveyor sections in each column are connected to one another by diverter belts located at the ends of the columns and the last conveyor section in one column is connected to the first conveyor section in an adjacent column by an offset transfer conveyor. In operation, a lapped stream of objects is fed into the input of the storage device travels in a serpentine manner along all of the interconnected conveyor sections in a first column, across the transfer conveyor to a second column where the process is repeated. The remaining columns are traversed in the same manner until the stream reaches the end of the last conveyor. Selected numbers of objects can be dispensed by operating the full unit for short periods of time to cause objects to exit from the discharge end of the unit. A control system for controlling the unit and an input system for creating a suitable lapped stream of papers are also disclosed.

22 Claims, 14 Drawing Sheets

METHOD AND APPARATUS FOR STORING AND DISPENSING THIN FLEXIBLE OBJECTS

This application is a continuation-in-part of U.S. application Ser. No. 08/781,808 filed Jan. 10, 1997, which in turn is a continuation of U.S. Provisional Application No. 60/009,943, filed Jan. 16, 1996.

The present invention relates to a method and apparatus for receiving, storing and dispensing thin flexible objects, and more particularly, to a method and apparatus for receiving and storing a high-speed stream of thin flexible objects, such as newspapers, and dispensing various quantities of these objects as needed.

BACKGROUND OF THE INVENTION

Newspapers go through three basic stages before reaching the consumer. These stages are commonly referred to as the press room stage, the mailroom stage, and the circulation stage. During the press room or printing stage, the newspapers are printed, cut and folded into complete papers at very high speeds. Typically the papers travel from the press stage to the mailroom stage as a high-speed stream of partially overlapped newspapers.

Since the uninterrupted operation of the printing press is of premium importance, there may be additional equipment, for instance, between the pressroom and mailroom stage to provide a buffer between the two. For example, if the stacking and bundling equipment stopped operating, the printing press could continue to operate provided that the stream of papers could be diverted to a buffer. Heretofore, the buffer system included a helical ramp with vertical shaft. The succession of newspapers was caused to run up the ramp. This was problematic because the newspapers would slide and turn resulting in ink becoming smudged and papers becoming creased.

Another buffer system comprises a drum onto which papers are rolled with the aid of a strap. This system was disadvantageous in that it only provided minimal storage capacity and required a large amount of floor space.

U.S. Pat. No. 5,018,618 discusses a system that requires significantly less floor space than the operating space required for the drum. This system comprises a vertically rising shelf unit that straddles the conveyed stream of newspapers and engages the outside edges of the newspapers. This shelf unit lifts the papers vertically and holds them in storage. The unit requires an upstream device to divide the succession of newspapers into longitudinal sections so that stacks of newspapers can be positioned on each shelf.

Once the papers arrive at the mailroom stage, either directly or from an intermediate storage device, the newspapers are arranged in stacks and bundled for distribution to various locations. The stacking and bundling operation is an expensive procedure that employs complex equipment. The bundles may be stacked in either fixed quantities for general distribution or in selected quantities for distribution to a particular distribution point. The variable size of these bundles complicates the bundling operation because the bundling machines must be able to accommodate the different bundles, and the stacking operation because the differently sized bundles will result in stacks of different sizes. The need to individually track each of the unique bundles complicates the circulation stage as well.

Complete bundles are delivered from the mailroom facility to the circulation stage by a conveyor or a cart or a similar transportation device. Typically, the bundles are taken to trucks, manually removed from the conveyor or cart, and loaded into the cargo space on the truck. This manual loading operation is slow and tedious, taking 45 minutes to an hour to fill a average truck. Because of the labor-intensive nature of this activity, the circulation stage adds significantly to the cost of newspaper printing and distribution.

In order to address this industry problem, systems were developed to automate the circulation stage. Such systems comprise loading carts and automatic cart loaders, such as those described in U.S. Pat. Nos. 5,181,820 and 5,437,537, that were used to receive bundles from the mailroom and place bundles into the carts. The carts were then manually wheeled into the cargo space of the truck. The carts were dimensioned so as to make the most economic use of the total cargo space volume. When the trucks reached their destination the carts were removed from the cargo space and unloaded.

Although automated systems help make better use of the cargo space and reduce some of the manual operations, these systems still involve the manual loading and unloading and do nothing to simplify the stacking and bundling operation in the mailroom stage. Furthermore, the newspapers were still in stacked bundles when delivered to retailers, door-to-door delivery people, and honor boxes. This meant that either 1) individual bundles of predetermined quantities of newspapers had to be prepared, individually tracked through the circulation stage, and delivered to a distribution point, or 2) the bundles had to be broken apart and separated at the distribution point in order to provide the required number of newspapers. In addition, many attempts have been made to provide a buffer for receiving the output of a printing press when problems occur downstream from the press, but these solutions have been expensive, and generally ineffective. It would therefore be desirable to provide a storage device for holding newspapers and the like that could be used as a component in a buffer system or that was movable and could be transported to delivery locations.

SUMMARY OF THE INVENTION

These and other problems are addressed by the present invention which comprises a method and apparatus for receiving newspapers, storing them in a compact manner, and dispensing selected quantities of papers as needed. While the invention can be practiced with any thin flexible material, such as flexible sheets of plastic, it finds an important practical use in the newspaper industry. Therefore, throughout this specification, the objects being stored may sometimes be referred to as "newspapers." However, the invention could be practiced with other printed material such as magazines and leaflets, or similar thin flexible objects. Reference herein to "newspapers" should therefore be read to include all such similar objects.

The invention comprises a system for receiving and storing a quantity of newspapers from a printing press and dispensing them at a destination without having to undergo the traditional operation of bundling the newspapers. More particularly, the present invention comprises to a newspaper storage and delivery system which includes a conveyor system for receiving and storing a stream of individual newspapers from a high speed printing press and means for dispensing a selected quantity of these newspapers when desired.

In a preferred embodiment of the present invention, a series of conveyors transport the newspapers from a printing press to a storage unit. One of these conveyors comprises a pair of band conveyors each having a series of spaced apart rollers and a plurality of elastic bands or belts supported by the rollers in a spaced apart arrangement. The space between the conveyors is sized to grip and transport a stream of newspapers, which may be partially overlapped, in virtually any orientation. The lower run of the upper band conveyor contacts the top surface of the stream of newspapers and holds each paper against the support surface, upper run, of the lower band conveyor. The two runs of the pair of conveyors are synchronized to travel in the same direction and at the same speed. Such conveyors are well known in the newspaper industry and are commonly referred to as "lap-stream" conveyors, because they are generally used to transport a continuous stream of partially overlapped newspapers. A second type of conveyor that might be used to transport the newspapers is called a gripper conveyor and comprises a continuous chain having gripping units depending therefrom which units each grip one individual newspaper and carry the newspaper in a vertical orientation. When the newspapers reach their destination, tripping devices actuate release mechanisms on the grippers to cause them to release the individual papers.

A series of paired band conveyors is used to convey a stream of papers from the high speed press to a storage unit which may be positioned within the plant, near a loading dock, or on a delivery truck. Alternately, the lap stream conveyors may carry the newspapers to a gripper conveyor, and the gripper conveyor will carry the papers to an input device located near the storage unit. The storage unit comprises several vertical stacks of substantially horizontal band conveyor sections for handling a continuous or non-continuous stream of newspapers. A diverter is located at the ends of these conveyors for directing a stream of newspapers either up or down to an adjacent conveyor level. A transfer is located at the end of the last conveyor in each stack for transferring papers to the first conveyor in the adjacent conveyor stack. The stacked conveyors and associated diverters are arranged so that there is a continuous conveyor path connecting all of the conveyors in a stack and each stack with each adjacent stack. All of the main conveyors, diverters, and transfer conveyors in the storage unit are synchronized and may be individually or gang driven from a single power source or from multiple power sources.

The stream of newspapers is supplied to an input on the storage unit. Typically, this input is located either at the top or bottom conveyor of one of the end stacks on the storage unit. The papers are conveyed from this input in a serpentine fashion through the storage unit until the leading edge of the stream of newspapers reaches the end of the last conveyor in the unit at which time the storage unit is completely filled. The papers are held securely between the upper and lower conveyors while the storage unit is transported to a location from which the papers are to be dispensed. Significantly, the unit is sufficiently lightweight and rugged that it can be transported in a newspaper delivery truck and withstand the rigors of over-the-road travel. When the unit arrives at a destination where papers are to be dispensed, it is operated to deliver a desired quantity of papers onto the ground, into a the arms of a waiting person, into an honor box, or into a delivery box which is a miniature version of the storage device described herein.

The delivery box of the present invention can be filled with papers by connecting the output of the storage device to the input of the delivery box and feeding a desired number of papers into the box. The box may be self-powered or the conveyors therein may be driven by connecting them to the storage unit. Papers are dispensed one at a time only after they are paid for, eliminating the problem of papers being stolen out of honor boxes. When the delivery box is self-powered, it can easily dispense one paper at a time as each paper is paid for. If the box is not self powered, it can be provided with a crank or similar arrangement that can be unlocked by the deposit of a coin for a sufficient time to allow only one paper to be dispensed.

It is therefore a principal object of the present invention to provide a storage device for storing and dispensing flat, flexible objects.

It is another object of the present invention to provide a storage device for receiving a stream of flat flexible objects and storing the objects in a continuous stream.

It is a further object of the present invention to provide a storage device for receiving a high-speed lap stream of newspapers, storing the papers in a fixed relationship, and dispensing individual newspapers from the storage device.

It is still another object of the present invention to provide a system for delivering newspapers from a printing press to a distribution point without bundling the papers.

It is yet another object of the present invention to provide an automated high volume per unit area newspaper storage device that firmly holds each newspaper and is capable of selectively dispensing newspapers.

It is yet a further object of the present invention to provide an automated continuous conveyor system comprising a series of closely arranged vertically stacked conveyors that receive, hold, and dispense newspapers.

It is still another object of the present invention to provide a buffer device for receiving a stream of newspapers and storing the newspapers until they are needed at a downstream processing or distribution step.

It is still a further object of the present invention to provide a storage device that can be filled with newspapers from a lap stream conveyor, loaded onto a delivery truck, and transported to a distribution location.

It is another object of the present invention to provide a diverter for changing the direction of a stream of flat flexible objects.

It is a further object of the present invention to provide a diverter for carrying a stream of newspapers through a small-radius turn.

It is still another object of the present invention to provide a diverter for changing the direction of flow of a lap stream of newspapers by about 180 degrees through a turn having a radius less than about the thickness of the lap stream.

BRIEF DESCRIPTION OF THE DRAWINGS

These and other objects of the present invention will become apparent from a reading and understanding of the following detailed description of a preferred embodiment of the invention together with the following drawings of which.

DETAILED DESCRIPTION OF THE PREFERRED EMBODIMENT

Figure 1:
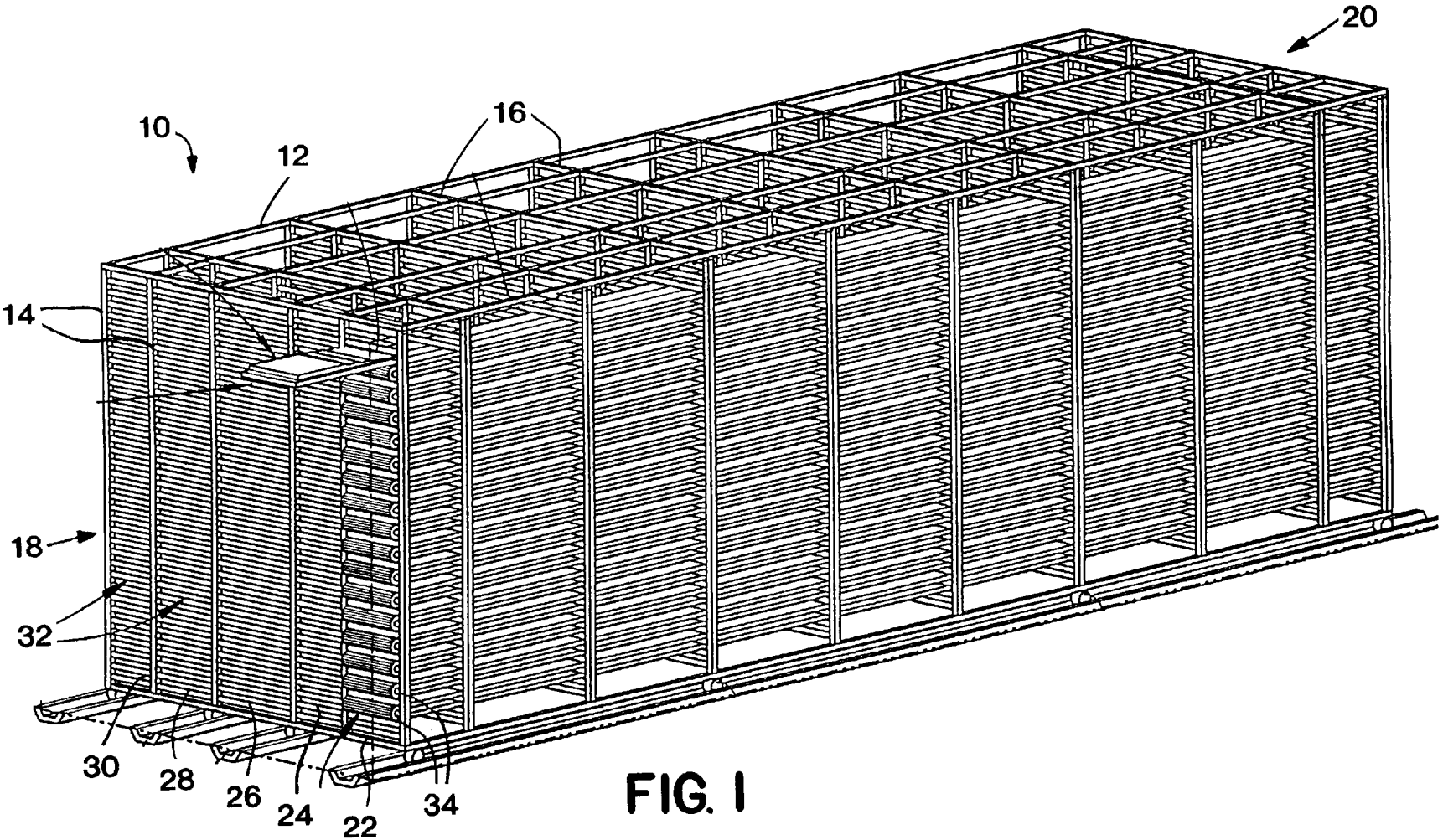
FIG. 1 is a pictorial view of a storage device according to the present invention.
Figures 4, 5, 6:
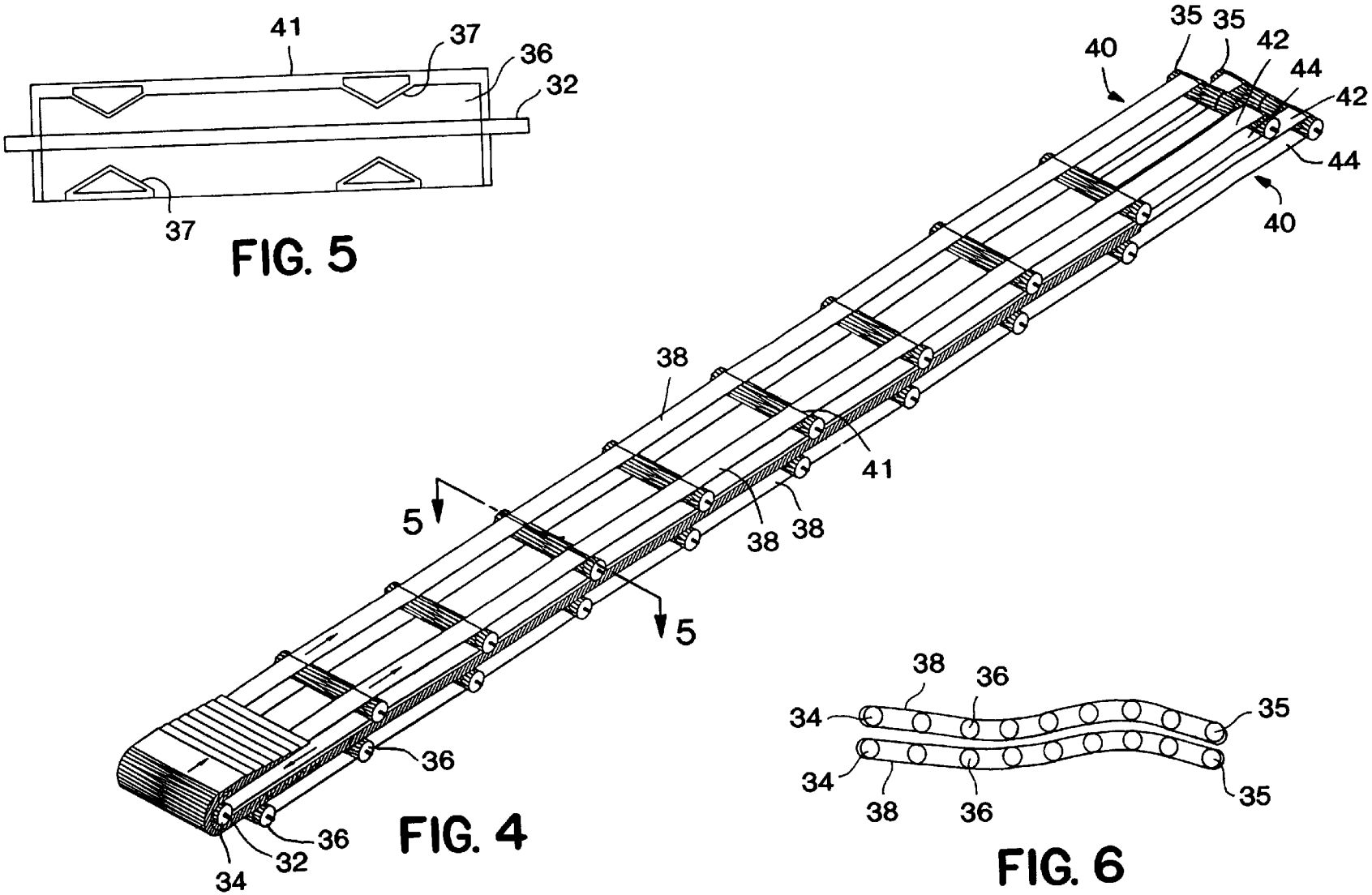
FIG. 4 is a pictorial view of two conveyors separated from the storage device of FIG. 1 and a number of newspapers being conveyed thereby.
FIG. 5 is a sectional view taken through line 5—5 in FIG. 4.
FIG. 6 is a schematic view showing the serpentine arrangement of the conveyors used in the storage device shown in FIG. 1.
Figure 8:
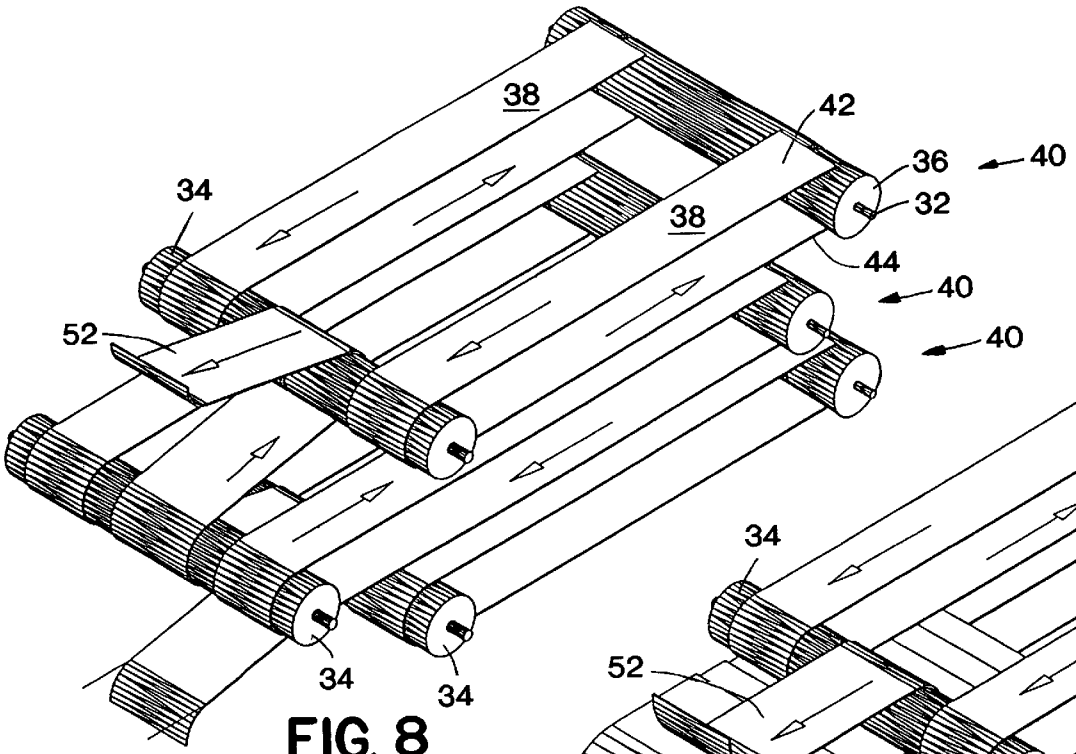
FIG. 8 is a pictorial detail of the ends of three conveyors showing the direction of belt travel and the relationship between the conveyor belts and the diverter belt.

Referring now to the drawings, wherein the showings are for purposes of illustrating a preferred embodiment of the subject invention only and not for purposes of limiting same, FIG. 1 shows a storage device 10 including a frame 12 comprising a number of vertical support members 14 and horizontal support members 16. Frame 12 has a front portion 18 and a rear portion 20 and is divided into five vertical columns 22, 24, 26, 28, and 30. As shown in FIGS. 1 and 5, a number of roller supports 32 are connected between pairs of vertical support members 14 to support a plurality of head rollers 34 , tail rollers 35 and return rollers 36 each having V-shaped guide portions 37. The head rollers 34 are located at thefront portion 18 of the unit while the tail rollers 35 are located at the rear portion 20 of the unit; the rollers between the head rollers and tail rollers are referred to as return or support rollers 36. The head and tail rollers perform similar functions and therefore only the head rollers will be described hereinafter when the tail rollers perform identical functions. Return rollers 36 are generally vertically aligned with the return rollers above and below them on different levels of each column. Head rollers 34 are arranged in two slightly offset columns such the head rollers on odd levels of a column are arranged in a first vertical column and head rollers on even levels of the column are similarly aligned. The tail rollers and return rollers are similarly aligned and offset, and furthermore, the offset is in the same direction as the offset of the head rollers. Thus if the head rollers on even levels of a column are located forwardly of the head rollers on odd levels, the tail rollers on even levels of that column will also be located forwardly of the tail rollers on the odd levels. This offset can best be seen in FIGS. 2 and 8.

In addition to being vertically aligned, the rollers 34, 35 and 36 are also arranged in generally horizontal rows, each of which supports a pair of conveyor belts 38 to form a plurality of generally parallel, generally horizontal conveyors 40. Conveyor belts 40 are preferably made from a material such as monofilament and a suitable material is manufactured by Habisat and sold under the designation HAT-8P. The belts are further characterized in that the tensile force required to producing a 1% elongation per unit of width is between about 20 and 36 pounds per inch and preferably about 28.5 pounds per inch. Each of these conveyors 40 is independently operable, although all will be driven in unison by the same drive mechanism. Each of belts 38 is kept in close contact with rollers 34, 35 and 36 by a holding wire 41 connected to roller supports 3l and passing over the roller and the belts as shown in FIG. 5.

Preferably, conveyors 40 are not planar, but rather shift up and down in a serpentine manner as they travel from front portion 18 toward rear portion 20 of the storage device. To accomplish this, the rollers 36 in a first vertical column are offset from the rollers in a subsequent vertical column to produce the desired serpentine effect. This serpentine arrangement is shown somewhat schematically in FIG. 6, but for purposes of clarity, conveyors 40 appear to be substantially planar in the other figures. Serpentining the belts in this manner produces a pinching effect and helps to hold the newspapers securely as they are carried by the conveyors 40.

Figure 9:
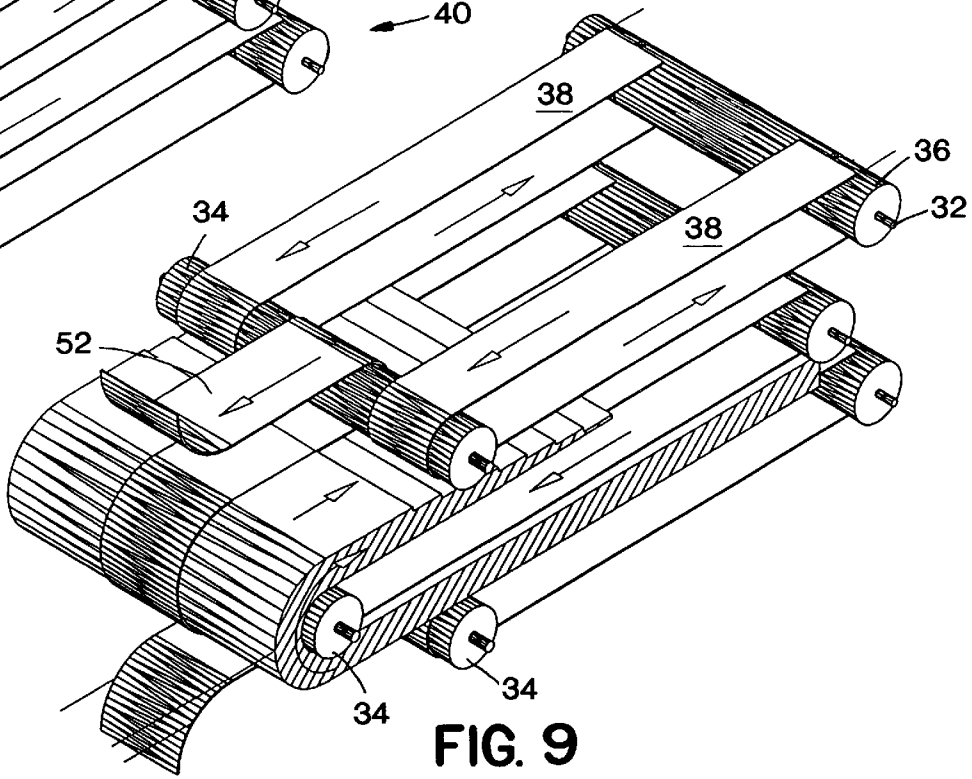
FIG. 9 is a pictorial detail of the conveyors shown in FIG. 7 which also shows the leading edge of a lap stream of newspapers being conveyed by the conveyors.

The conveyor belts 38 are preferably V-shaped belts about three inches in width, which fit within the V-shaped guide portions 37 of the rollers. Alternately, round, flat, or other types of belts could be used. Each conveyor 40 can be described as a conveyor run extending from front 18 to rear 20 of the storage device and furthermore, each run includes a top portion 42 and a bottom portion 44. The terms "top" and "bottom" refer to the orientation of the device in normal use, top portions 42 being located above the rollers supporting that particular belt 38 and the bottom portion 44 being located below the supporting rollers. It will be appreciated that because conveyor belts 38 are endless, a given segment of belt may comprise part of the top belt portion at one moment and part of the bottom belt portion the next. The conveyors 40 are arranged in each column such that the bottom portion 44 of a given conveyor belt is located above and slightly spaced apart from the top belt portion 42 of the conveyor immediately beneath. The conveyors are connected to a drive mechanism that will be described hereinafter, that drives the conveyors on odd levels of the storage device in a first direction and the conveyors on the even levels in the opposite direction. As will be appreciated from the drawings, especially FIGS. 2, 8 and 9, this causes the top portion of one conveyor 40 to travel in the same direction as the bottom portion of the conveyor immediately above it. This results in the creation of a flow path between any two conveyors such that objects inserted between them will be gripped by the bottom portion of one conveyor and the top portion of another conveyor and carried along in the direction of travel of the spaced apart conveyors that define that flow path. Each column 24, 26, 28, and 30 also includes a plurality of conveyors 40 which function in the same manner as those in column 22.

Figures 2, 3:
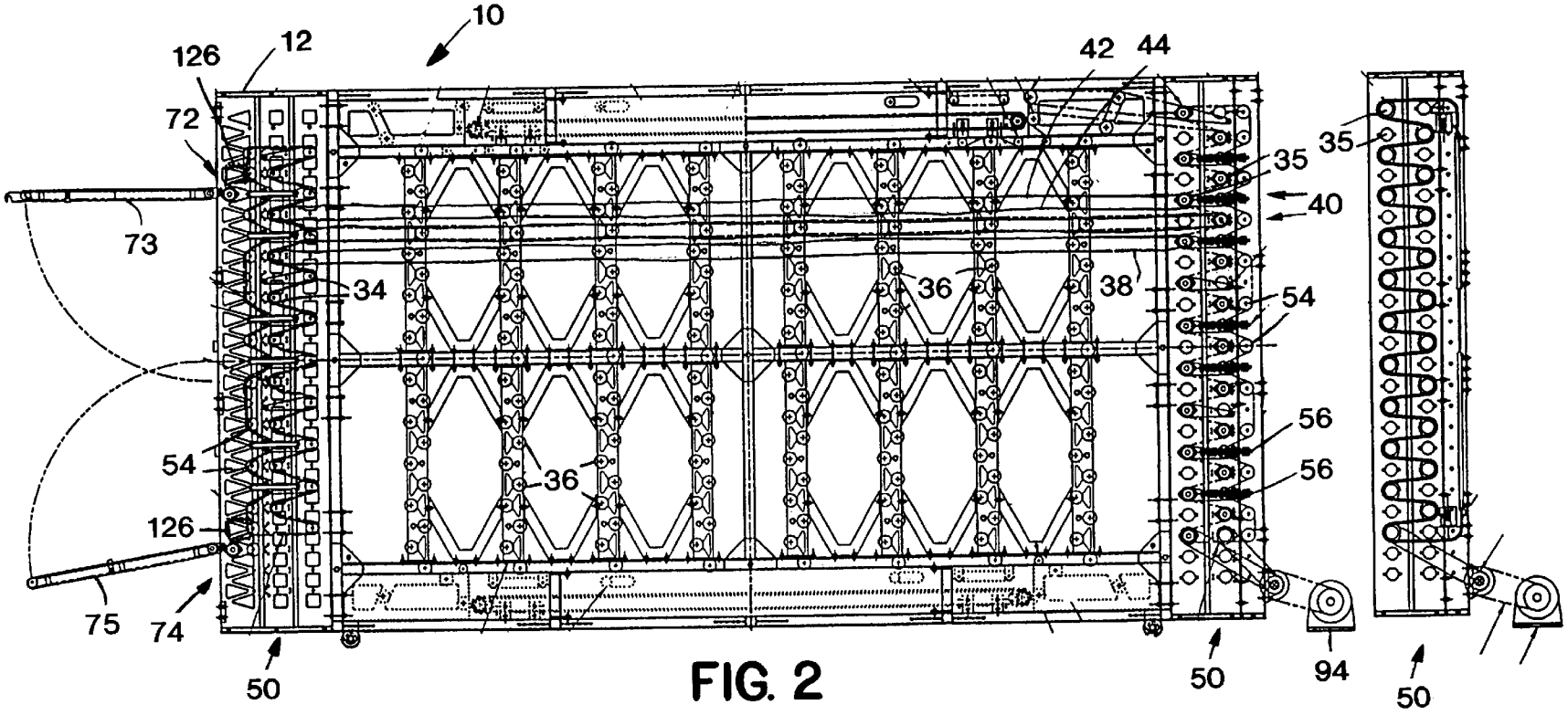
FIG. 2 is a side elevational view of the storage device of FIG. 1 with many of the conveyor belts removed to show the belt supports and the structure of the diverters.
FIG. 3 is a side elevational view of the drive unit of the present invention.

Storage unit 10 also includes a pair of diverters 50 located at front portion 18 and rear portion 20 of storage device 10 which serve to transfer objects traveling along one flow path to the next higher or lower flow path. The diverters at the front and rear of the device are substantially identical, except that they are offset by one level. In other words, the rear diverter will transfer objects from the first level to the second level, the front diverter will transfer objects from the second level to the third level, the rear diverter will transfer objects from the third level to the fourth level, etc. Each diverter 50 comprises a continuous belt 52 which passes around each of head rollers 34 between the conveyor belts 38 and after passing around the bottommost head roller 34 returns via a plurality of idler rollers 54 to the topmost head roller 34. The diverters are shown in FIG. 2 and the arrangement of the belts 38 and 52 on head rollers 34 can best be seen in FIGS. 8 and 9. Belts 52 are preferably made from a somewhat elastic material, such as monofilament and are characterized in that the tensile force required to produce a 1% elongation per unit inch of width is between about 4.5 and 5.5 pounds per inch and preferably, about 5.1 pounds per inch. One material with suitable properties is manufactured by Habisat and sold under the designation MAT-02H. The elasticity of belts 52 allows the belts to stretch as objects pass between head rollers 34 and diverter belts 52 as will be described hereinafter in connection with the operation of the device.

Previously, when the direction of a lapped stream conveyor needed to be changed, the conveyor was curved through a wide radius turn, the radius often being twelve to eighteen inches. This was suitable in large printing plants where large spaces were available through which to guide these conveyors. However such large radius turns cannot be used to store a high concentration of papers in a storage device as the turns would take up too much space. It was found, however, that when diverters such as the above were used, the direction of travel of newspapers in a lapped stream conveyor could be changed over a very short distance and through a small radius turn. Thus according to the present invention, it is possible to change the direction of a flow of newspapers by 90 or even 180 degrees by using diverters and turning the flow about a turn-around roller having a radius of less than about six inches, and more particularly having a radius of less than about three inches, and in a specific case, having a radius of about 1.25 inches. The smallest possible radius that can be used for a given turn depends on the thickness of the stream of material being conveyed. In the present case, the 1.25 inch radius of the roller is less than the thickness of the lapped stream of objects. The use of a turn around roller having a radius less than the thickness of the stream being turned allows for tighter packing of lapped stream conveyors than was heretofore thought possible.

Figure 12:
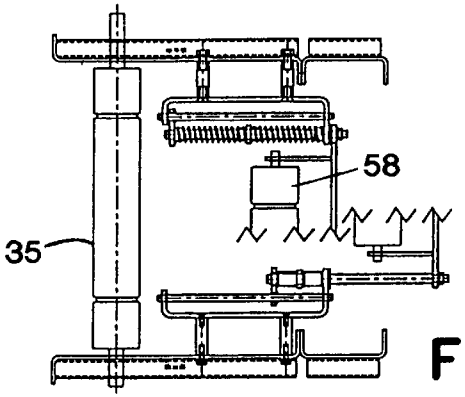
FIG. 12 is a plan view of the conveyor ends and belt take-up device shown in FIG. 11.
Figure 11:
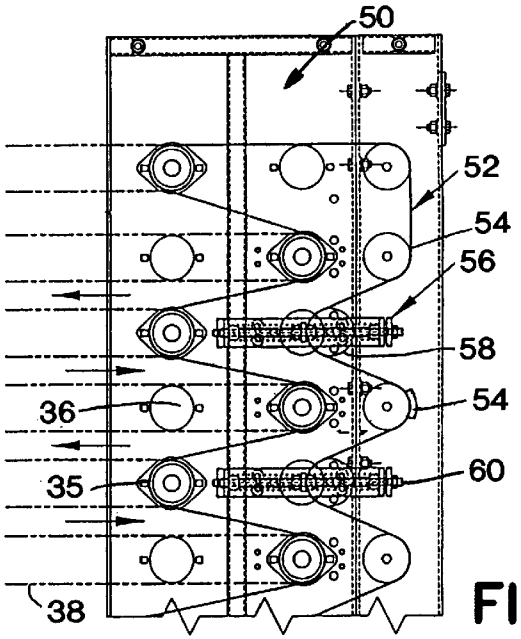
FIG. 11 is a side elevational view of the ends of the conveyors shown in FIG. 7 which also shows a belt take-up mechanism for maintaining tension on the diverter belt.

Diverters 50 also include tensioning mechanisms 56, shown in FIGS. 2,11 and 12, which serve to take up any slack in diverter belts 52 and to maintain a generally constant tension in the diverter belts. The mechanisms 56 comprise dancer rollers 58 spring biased against the portion of belt 52 between a pair of idler rollers 54 which deflect belt 52 from its normal path of travel over idler rollers 54 and thereby provide for a longer belt travel path around the head and idler rollers. Dancer rollers 58 bias belt 52 toward head rollers 34 in a direction generally parallel to the direction of travel of conveyors 40 and are slidingly mounted on supports 60 for travel back in forth in this direction. When tension in belt 52 increases, dancer rollers 58 slide toward idler rollers 54 on supports 60 to decrease the length of the path of travel of belt 52 and to lower the tension in the belt. Likewise, when the tension in belt 52 drops, dancer rollers 58 slide on supports 60 away from idler rollers 54 to lengthen the path of travel of belt 52 and increase the tension on the belt. While this tensioning mechanism has been found to be effective, other known mechanisms for maintaining tension in a moving belt could also be used without exceeding the scope of the present invention.

Figure 10:
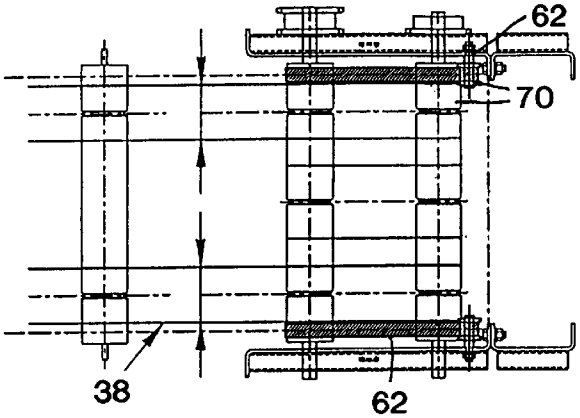
FIG. 10 is a plan view of the ends conveyor ends shown in FIG. 7.
Figure 7:
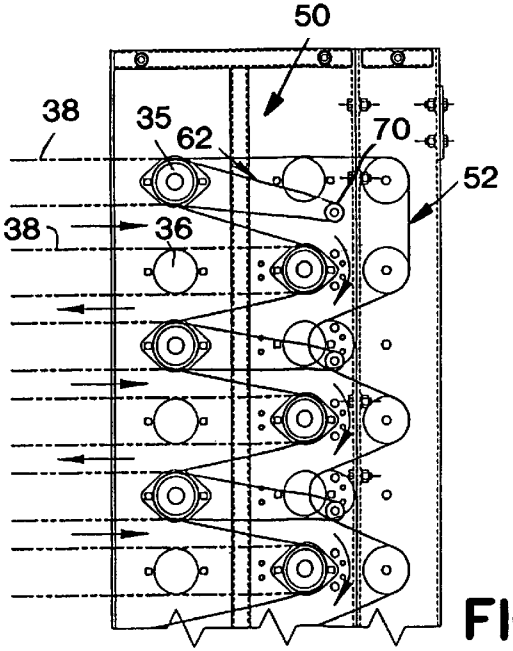
FIG. 7 is a side elevational view of the ends of several of the conveyors shown in FIG. 1 and the diverter mechanism used for moving objects from one conveyor level to another.
Figure 13:
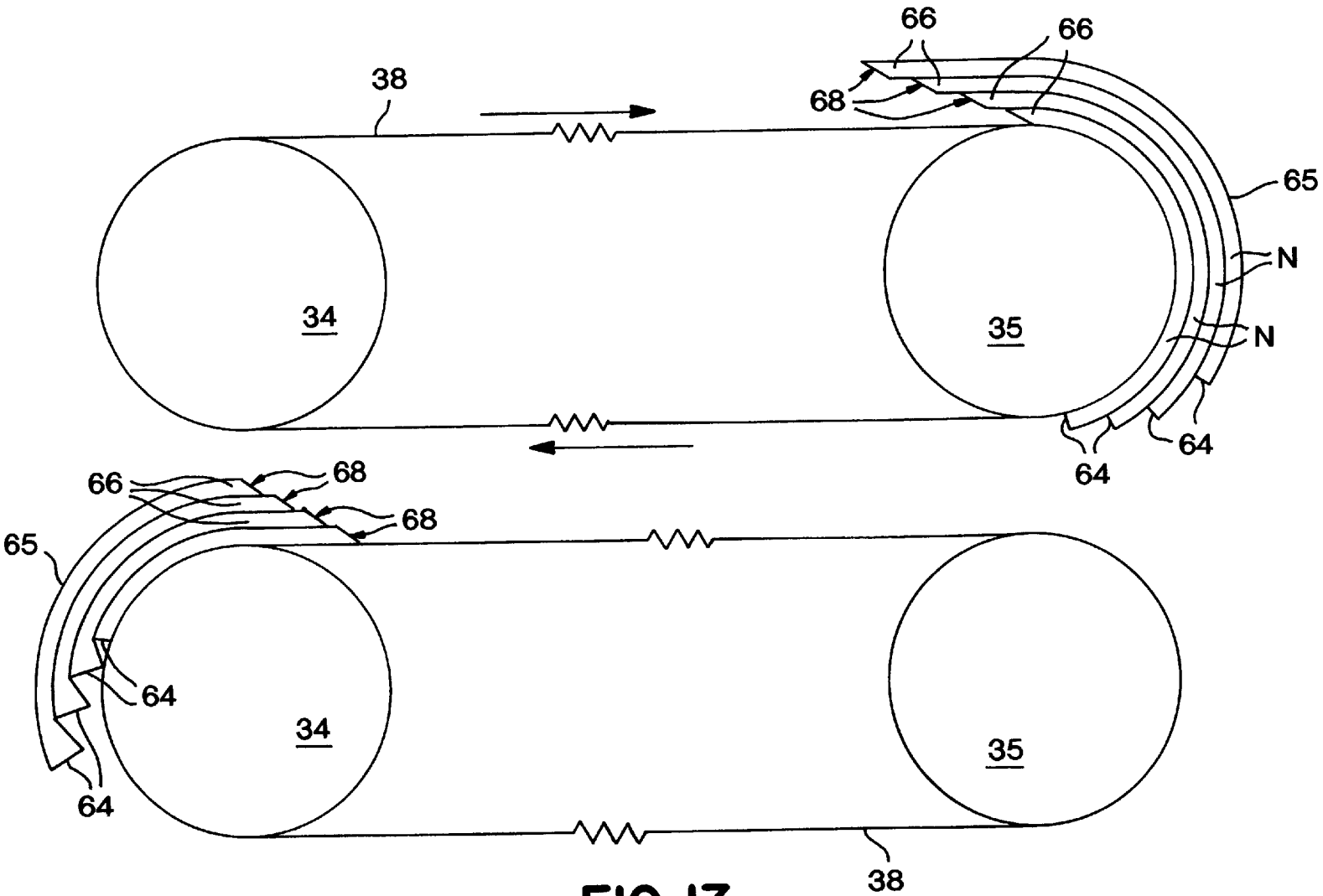
FIG. 13 is a schematic side elevational view of two conveyors showing the orientation of several newspapers passing around the ends of the conveyors.

Diverter 50 located at the rear 20 of storage device 10 also includes flap hold down belts 62 which are shown in FIGS. 7 and 10. The need for these belts can be understood with reference to FIG. 13 in which the passage of a small number of newspapers around head rollers 34 and tail rollers 35 is shown schematically. Each of newspapers N includes a fold edge 64 and a free edge 66. As the name implies, the fold edge is the edge in the vicinity of the center fold of the newspaper. In addition, only the outermost page 65 of the newspaper is exposed at fold edge 66. Free edge 64 is located on the opposite side of the newspaper from fold edge 66 and at this edge the ends 68 of all of the individual pages which make up the newspaper are exposed. When the papers pass around tail roller 35, shown to the right in FIG. 13, ends 68 of the individual pages of the papers are held down by outermost page 65 and are protected. When a lapped stream of papers passes around a tail roller in this orientation the lap stream is said to be going around the roller the strong way or in the strong direction. It is not necessary to use flap hold down belts in connection with rollers about which newspapers pass in the strong direction. When the lapped stream passes around the head roller 34 as shown on the left in FIG. 13, however, ends 68 of the papers are exposed and tend to ruffle or flutter as they pass around the roller. This fluttering is undesirable because it can bend the edges of the newspapers, or, if the edges come into contact with other moving parts of the device, the edges can be torn from many of the papers. Therefore, when papers pass around a head roller in this direction, the weak direction, it is necessary to use flap hold down belts 62 to protect edges 68. It should be noted that if storage device 10 is used to store a stream of newspapers that is not lapped, edges 68 of the papers will be exposed when they pass about both the head rollers and the tail rollers. There will be no strong direction when the papers are not lapped and thus it is desirable to include flap hold down rollers on both the front and rear diverters.

As can be seen in FIGS. 7 and 10, flap hold down belts 62 are located on head rollers 34 outwardly from each conveyor belt 38 and are also supported by a secondary support roller 70. Hold down belts 62 contact the free edge 68 of the newspapers as they pass around each head roller to prevent the edges from fluttering. Belts 62 are driven by the motion of the head rollers and therefore no separate power source is needed for these belts.

Each of the columns 22, 24, 26, 28, and 30 may be provided with an input and individually filled by feeding newspapers into each input. This may be desirable if it is necessary to load a number of different newspapers or newspaper sections into a give storage device. Normally, however, the columns are connected together so that newspapers N can be fed into a single input 72 via an infeed gate 73 at the top of column 22, for example, and pass through each of the columns 22, 24, 26, 28 and 30 before exiting from an output 74 onto an outfeed gate 75 at the bottom of column 30. This allows a large number of papers to be stored in one device.

Figure 14:
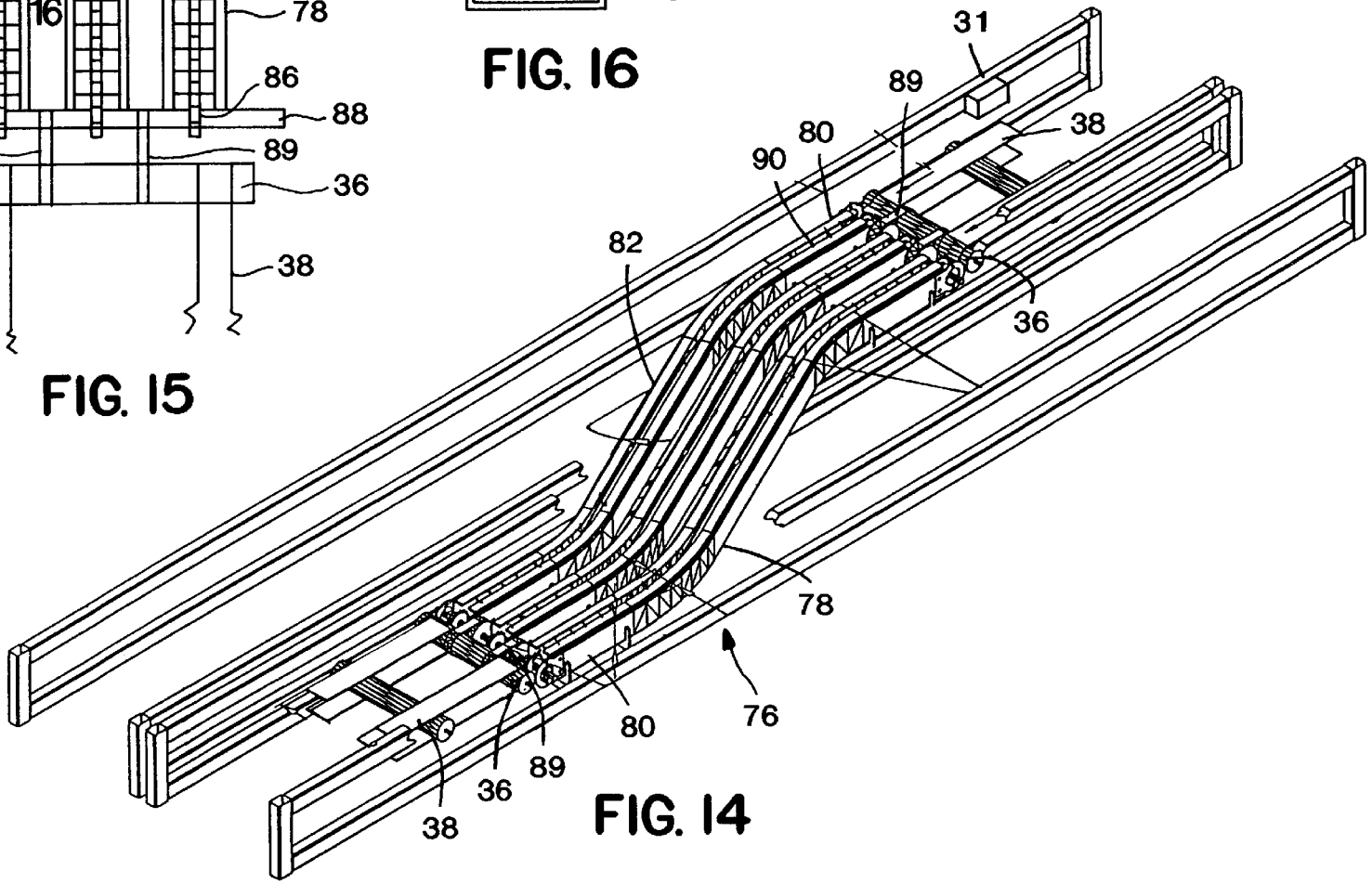
FIG. 14 is pictorial view of one of the transfer mechanisms used to transfer objects from one conveyor column to another.
Figure 16:
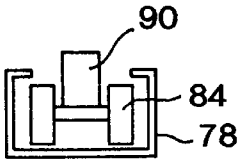
FIG. 16 is a sectional view taken through line 16—16 in FIG. 15.
Figure 15:
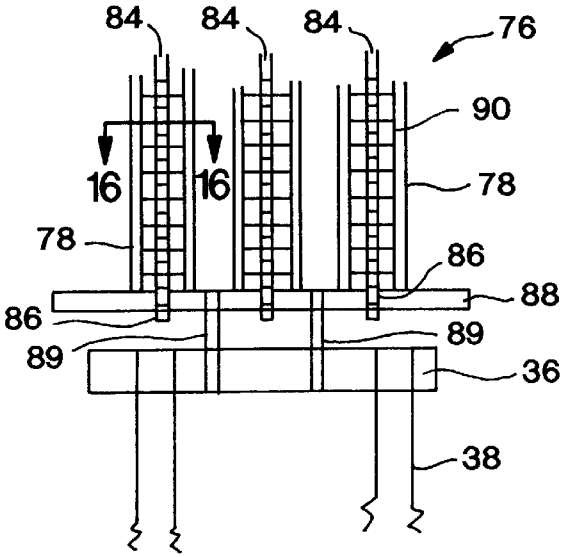
FIG. 15 is a plan view of the connection between the transfer mechanism and the conveyor belts in FIG. 14.
Figure 23:
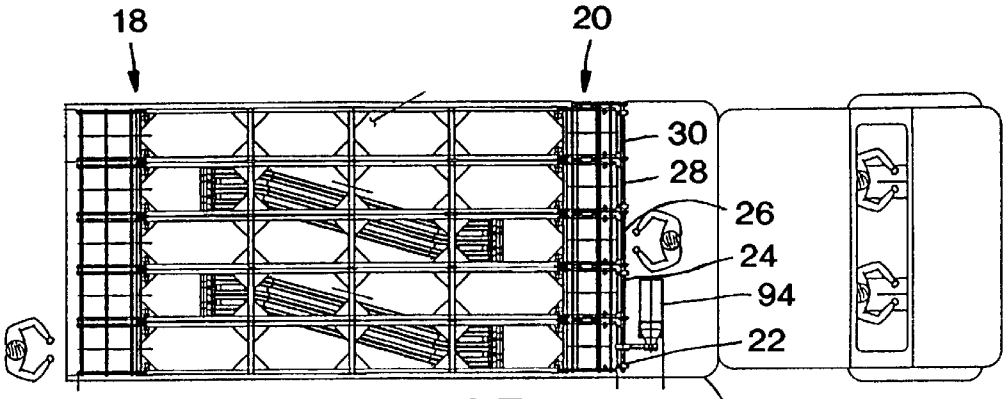
FIG. 23 is a top plan view, partly is section, of the truck and storage device shown in FIG. 21.
Figure 21:
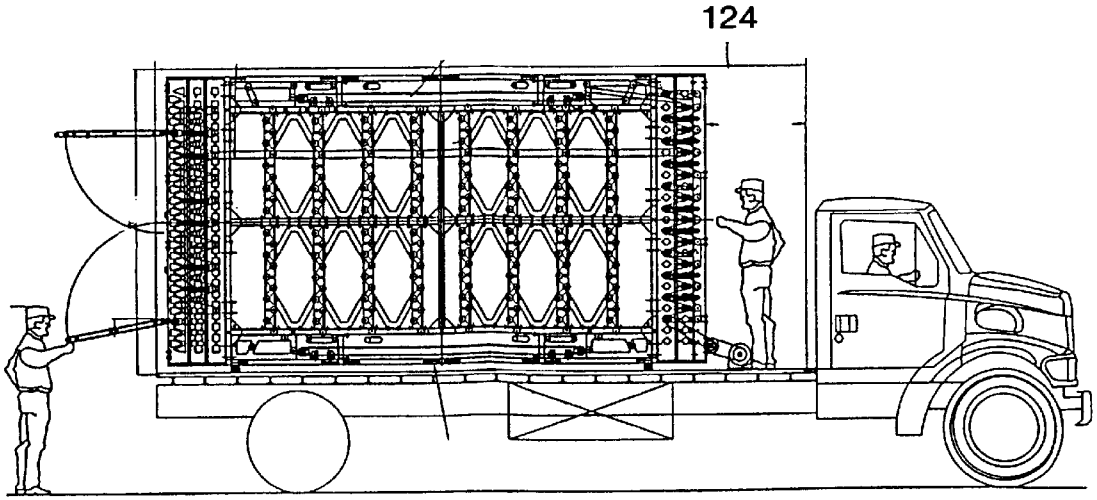
FIG. 21 is a side elevational view, partly in section, showing the storage device of the present invention mounted in a truck.

In order to transfer papers from one column to another, a number of column to column transfers 76 are provided. One of these transfers is shown in FIG. 14 and can also be seen in FIG. 23. Transfers 76 each comprise three channel sections 78 which include parallel end portions 80 offset from each other and connected by central portions 82. Transfer 76 shown in FIG. 14 connects the bottommost conveyor 40 of column 22 to the bottommost conveyor 40 of column 24. Each of the channel sections 78 is roughly C-shaped and houses a roller chain 84 which is supported on either end of the channel by a sprocket 86 on an axle 88. Axle 88 is connected to one of the return rollers 36 by a pair of belts 89, and the rotation of the return rollers is imparted to axle 88 to power transfer 76. Roller chain 84 is flexible in a lateral direction and can therefore traverse the offset channels in the channel sections without difficulty. A number of rectangular plastic slats 90 extend perpendicularly from roller chain 84 outwardly of channel sections 78 and are carried by chain 84 as it rotates in the channel. Axles 88 are connected to return rollers 36 by connector belts 92 which turn in the same direction as conveyor belts 38. In this manner, transfer 76 serves as a continuation of conveyors 40 but includes an offset portion to shift newspapers N from one column to the next. Plastic slats 90 engage newspapers N as they are pushed off of one section of conveyor 40 onto an end portion 80 of transfer 76 and carry the newspapers along the transfer to the opposite transfer end portion 80 from which point the papers are pushed onto a conveyor 40 in the adjacent column. In a five column storage device such as the one described herein, transfers 76 are needed at the bottom of the device below columns 22 and 24 and between columns 26 and 28 and at the top of the device between columns 24 and 26 and between columns 28 and 30 in order to define a continuous flow path from input 72 to output 74.

Each of the columns 22, 24, 26, and 28 includes a column full sensor 31 as shown in FIG. 14 located just upstream from the transfer 76 at the end of that column. The column full sensor for column 30 is located just upstream from output 74. These sensors 31 may be switches or optical sensors that detect the presence of a newspaper near the sensor and which produce an output as long as a newspaper remains in proximity to the switch. These switches send signals to a controller to indicate that a given column or the entire storage unit is full. By monitoring these sensors it is possible to detect possible jam conditions in the storage unit and to know when the unit is almost full as will be described hereinafter.

Figure 17:
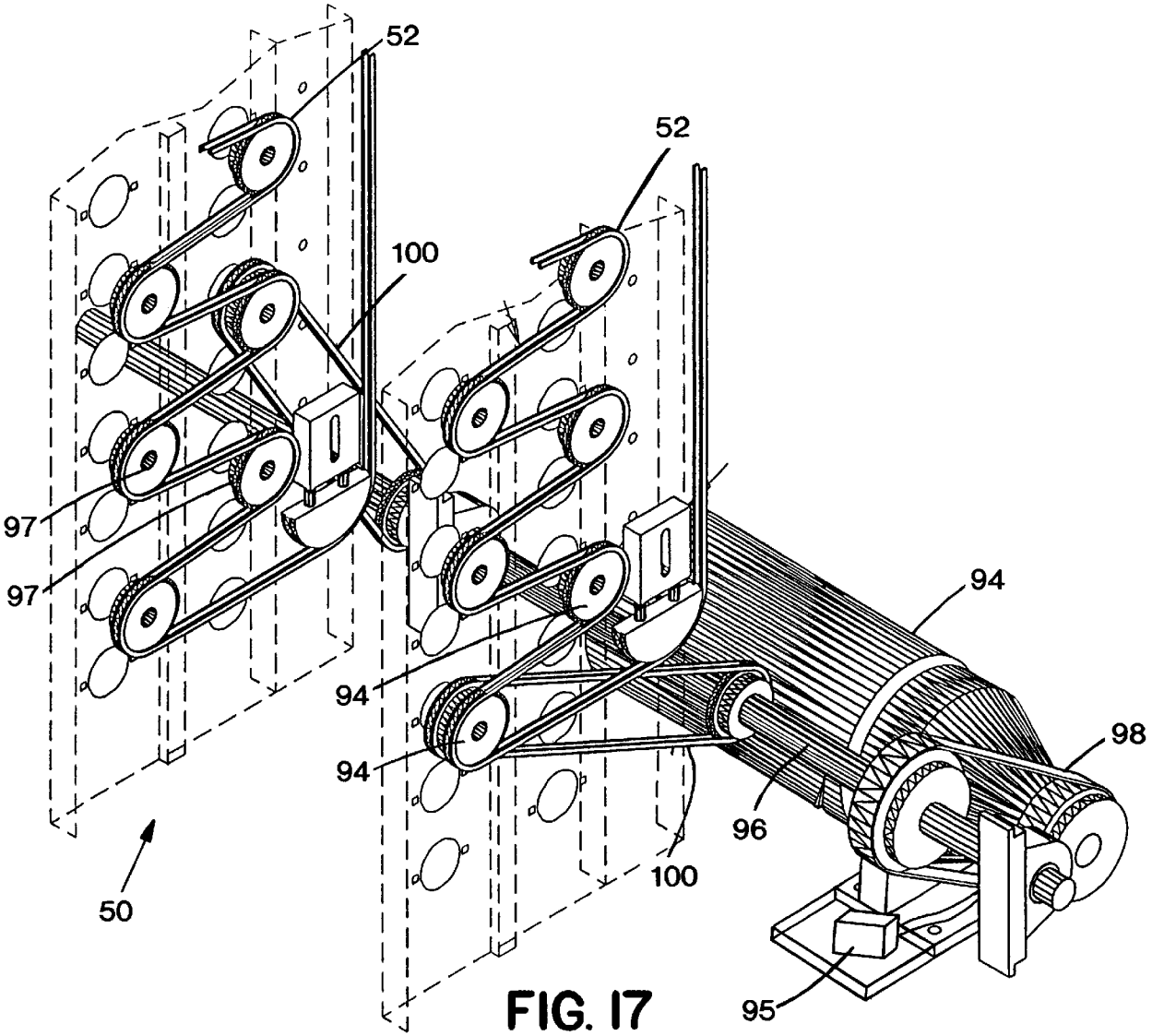
FIG. 17 is a pictorial view of the drive unit for the storage unit of the subject invention.

FIG. 17 shows a motor 94 for powering device 10 including conveyor belts 38, diverter belts 52, flap hold down belts 62 and transfers 76. Motor 94 is preferably a Sumitomo gear motor and is connected to a drive shaft 96 by a belt 98 and is controlled by a motor controller 95. Each of the tail rollers 35 includes a drive sprocket 97. An endless drive chain 99 loops around each of the sprockets in a given column in a serpentine manner and also passes over a chain tensioning device 101. Drive shaft 96 extends the width of all five columns and is connected to one of the sprockets 97 and drive chains on each column by a drive belt 100. As drive shaft 96 is rotated by motor 94, it causes each of the drive belts 100 and hence each of the drive chains 99 and drive sprockets 97 to rotate in unison. The rotation of the drive sprockets causes tail rollers 35 to rotate. Because conveyor belts 52, flap hold down belts 62 and transfers 76 are all interconnected as described above, these five connections to drive shaft 96 are adequate to power storage device 10. Alternately, multiple motors could be provided and used to power each of the drive chains individually, such as when the columns are not interconnected and it is desired to operate each column separately. Multiple motors could also be used to power several interconnected columns, but it would be necessary to synchronize the motors to that the conveyors in each column all operated at the same speed.

In order to load storage unit 10, it is necessary to provide a lapped stream of newspapers N having a given thickness to input 72 and to match the speed of the incoming papers to the speed of the conveyors 40. In the preferred embodiment, the desired lap stream thickness is one and one half inches. This thickness is determined by the spacing between the top portion 42 of one conveyor 40 and the bottom portion 44 of the adjacent conveyor. The spacing between the top and bottom portions in the preferred embodiment is just under one and one half inches to ensure that the papers will be tightly gripped by the spaced apart conveyors.

Figure 18:
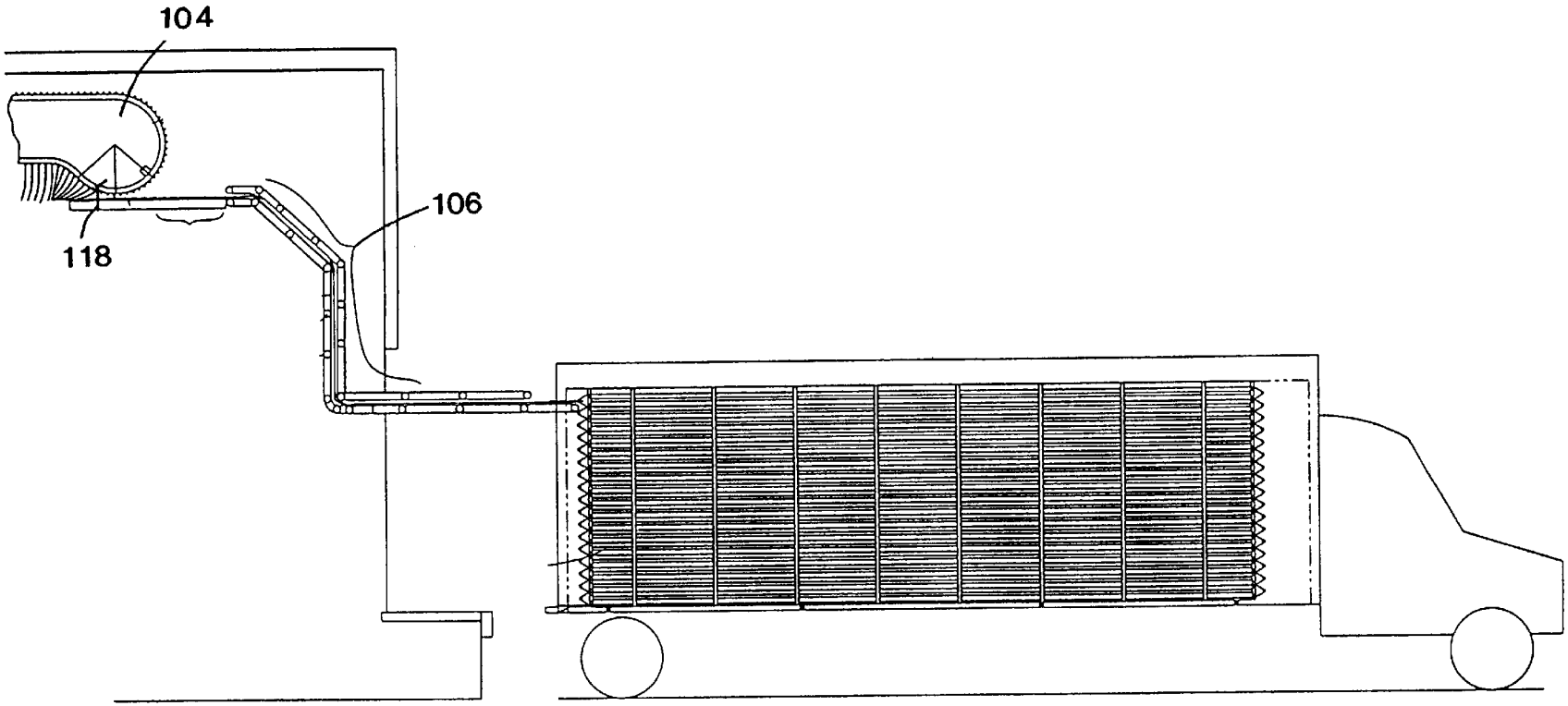
FIG. 18 is a side elevational view, partly in section, showing a series of newspapers being deposited in a lap stream onto a conveyor and traveling along the conveyor and into the storage device of the present invention.
Figure 19:
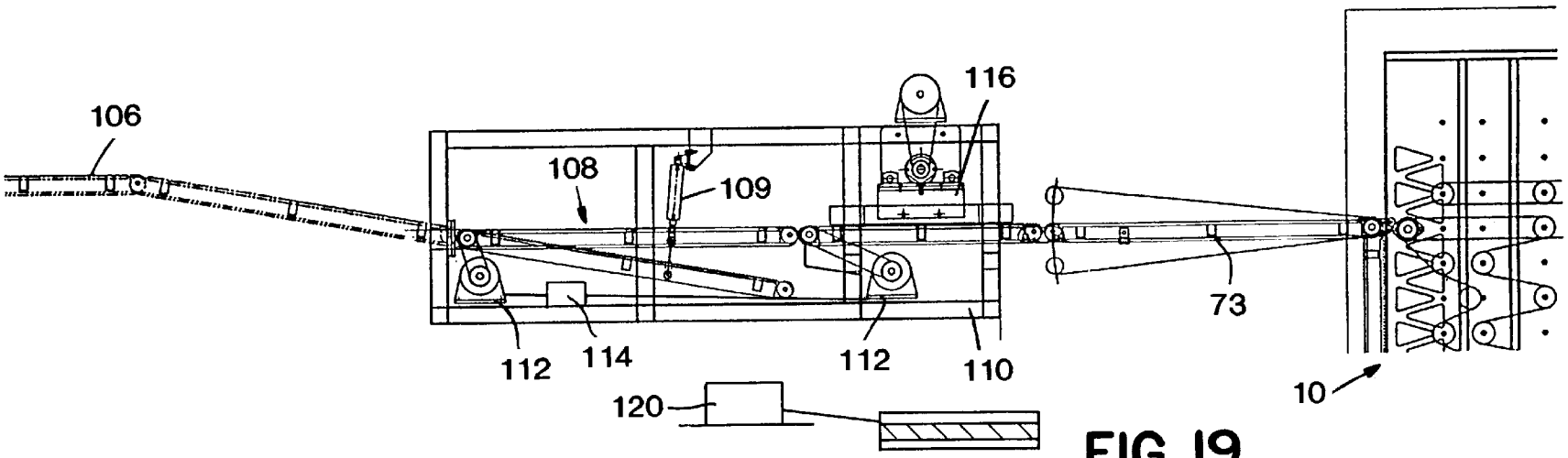
FIG. 19 is a side elevational view of one of the transfer conveyors used for bringing a lapped stream of newspapers to the storage device shown in FIG. 1.
Figure 20:
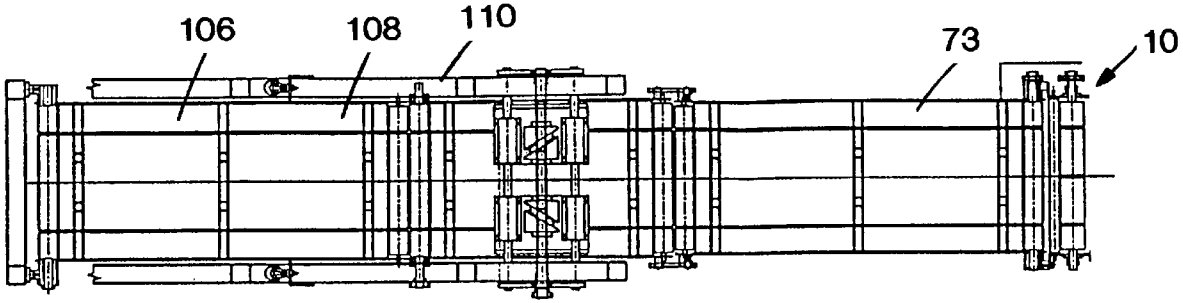
FIG. 20 is a plan view of the transfer conveyor shown in FIG. 19.

A gripper conveyor 104 provides newspapers to a plurality of infeed conveyors 106, one of which is shown schematically in FIG. 18 and in detail in FIGS. 19 and 20, and these infeed conveyors are used for filling a number of storage units 10 sequentially or simultaneously depending on certain conditions such as the thickness of the papers and the maximum input speed of the storage device. Newspapers arrive at infeed conveyors 106 carried by a gripper conveyor 104 which travels at a very high speed to accommodate the output of the high speed printing presses. This speed is significantly higher than the maximum speed at which the storage device can be operated, about 167 feet per minute. However, if gripper 104 deposits newspapers N into a lapped stream, the speed of the lapped stream is formed when a gripper conveyor drops papers onto a belt conveyor moving at a slower speed than the gripper conveyor. The greater the difference in speeds between the gripper conveyor and the infeed conveyor, the greater the amount of overlap of the newspapers. If the newspapers are sufficiently thin, the amount of overlap can be great, and the speed of the infeed conveyor can be set at a level that can be accommodatred by a storage device 10. A large overlap could be used with thicker papers as well; however the resulting lapped stream would be too thick for a storage device 10 to handle. For thicker papers, the infeed conveyor speed must be kept at or above a certain level to prevent the lap stream from becoming too thick. Given this limitation, in order to produce lapped streams of a given thickness it is necessary to devede the output of gripper conveyor 104 into two or more lapped streams. This can be accomplished by using a tripper device 118 to make the gripper conveyor 104 drop every nth paper at a certain time. Thus, for example, if two storage units 10 are to be filled simultaneously, a first tripper 118 would cause the gripper conveyor to release the remaining papers at a second infedd conveyeor. The calculations required for determining infeed speeds and number of drop points, as well as the mechanisms used to transfer papers from the gripper conveyor to the storage unit will be described in greater detail hereinafter.

Each infeed conveyor 106 comprises a number of individual conveyor sections including a hinged drop or dump gate section 108, controlled by a drop gate actuator 109, which can be opened to direct the flow of papers away from input 72 and onto the ground when a possible jam is detected in the storage unit 10. Drop gate 108 is shown in FIG. 19 in its closed position in solid lines and in its open position in dashed lines. A frame 110 supports drop gate 108, motors 112 for driving infeed conveyor 106, motor controls 114 for controlling motors 112, and a squaring unit 116 for squaring the edgers of the papers before they are fed into input 72. A number of trippers 118 are also provided for causing gripper conveyor 104 to release every nth newspaper onto a given infeed conveyor 106.

A programmable logic controller (PLC) 120 is optically connected to motor controllers 95 (see FIG. 17) and 114 as well as to column full sensors 31 (see FIG. 4), sensors for detecting the speed of gripper conveyor 104, drop gate controller 109, and to trippers 118. PLC 120 also includes an input 122 for recieving information on the page count of the newspaper, and on the gripper pitch or distance between successive newspapers on the gripper conveyor, whether this information is entered manually or via a signal from the printing operation. The PLC calculates the speed of the infeed conveyor and the number of required drop points based on the newspaper page count which has been entered into the system. The infeed speed and number of infeed conveyors needed is calculated below.

In general, the infeed speed is:

$$IS = \frac{GS}{GP} * \frac{NL * PT}{ST}$$

where:

IS=infeed speed in feet per minute;

GS=gripper speed in feet per minute;

GP=gripper pitch in inches;

NL=newspaper length in inches;

PT=newspaper thickness in inches; and,

ST=lapped stream thickness in inches.

When the required infeed speed is greater than the maximum infeed speed that can be tolerated by the storage device, the needed infeed speed is divided by the maximum allowable infeed speed and the result is rounded up to obtain the number of drop points that must be used, with the infeed speed being set equal to the needed infeed speed divided by the number of drop points.

In the preferred embodiment, the lapped stream thickness is a constant 1.5 inches and the newspaper thickness is considered to be 0.003 times the number of pages in the newspaper. Furthermore, the maximum allowable infeed speed is known to be 167 feet per minute. Given these constants, the following calculations can be used.

For page counts of 63 pages and below, all papers are directed to a single infeed conveyor and storage devices are filled one at a time. The infeed speed is set to be equal to:

$$\frac{\text{Gripper Speed}}{\text{Gripper Pitch}} \times (0.024 \times \text{Page Count})$$

For page counts between 64 pages and 124 pages, two drop points are used, that is the papers are dropped from gripper 104 onto two infeed conveyors and the infeed speed is set to:

$$\frac{\text{Gripper Speed}}{\text{Gripper Pitch}} \times (0.012 \times \text{Page Count})$$

Figure 27:
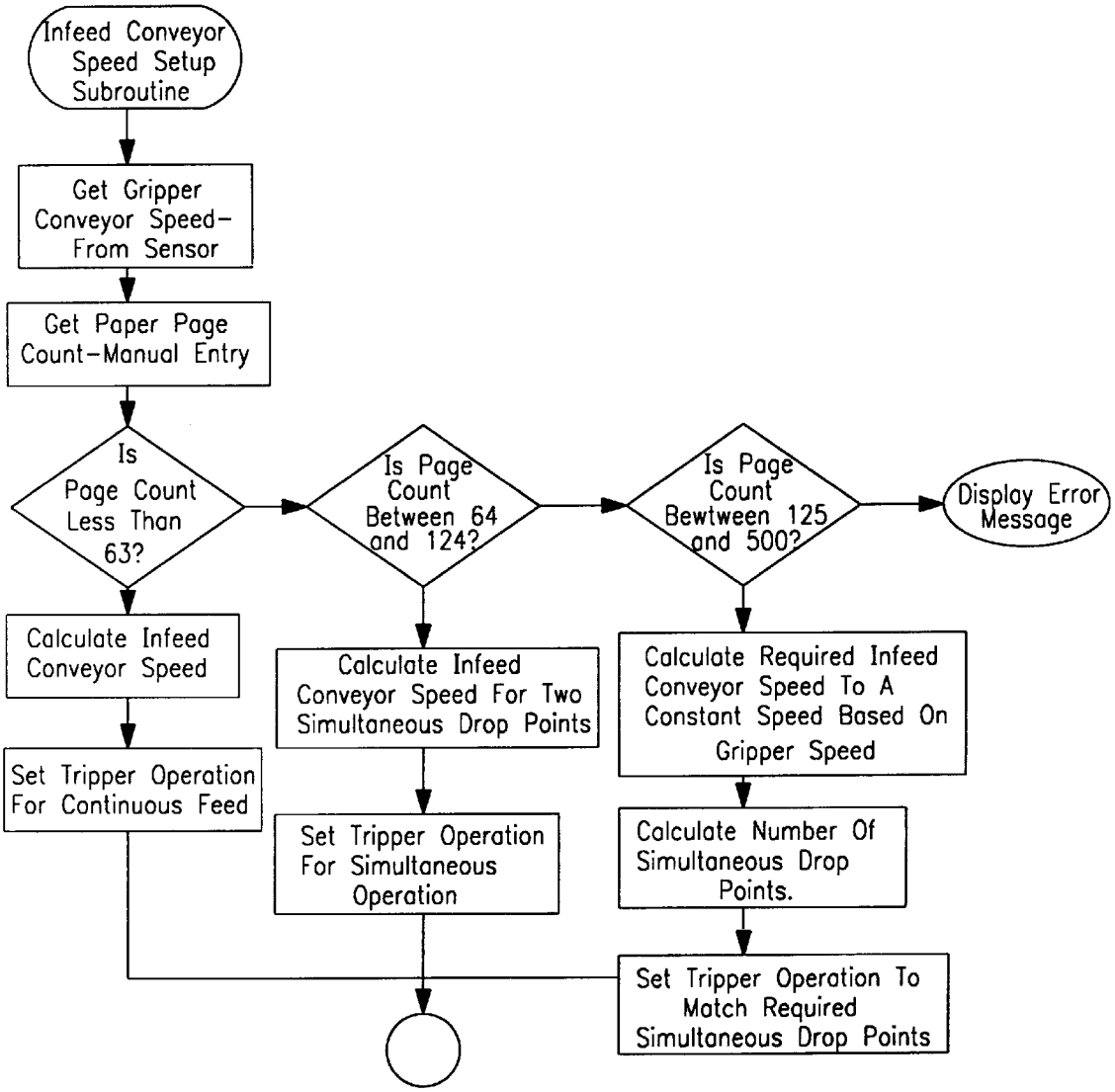

For page counts greater than 125 pages, the infeed speed is set to a constant 167 feet per minute and the number of drop points (i.e., infeed conveyors) is increased. The number of drop points necessary for a given page count is: 0.016× Page Count. Thus, for a 500 page thick newspaper, eight drop points onto eight infeed conveyors would be needed. In this limiting case, the newspapers will each be one and one half inches thick and will not be lapped, but rather will be fed into storage units 10 with the free edge 66 of one newspaper substantially touching the fold edge 64 of the preceding paper. FIG. 27 shows graphically the steps involved in determining infeed speed and the number of drop points.

Figure 25:
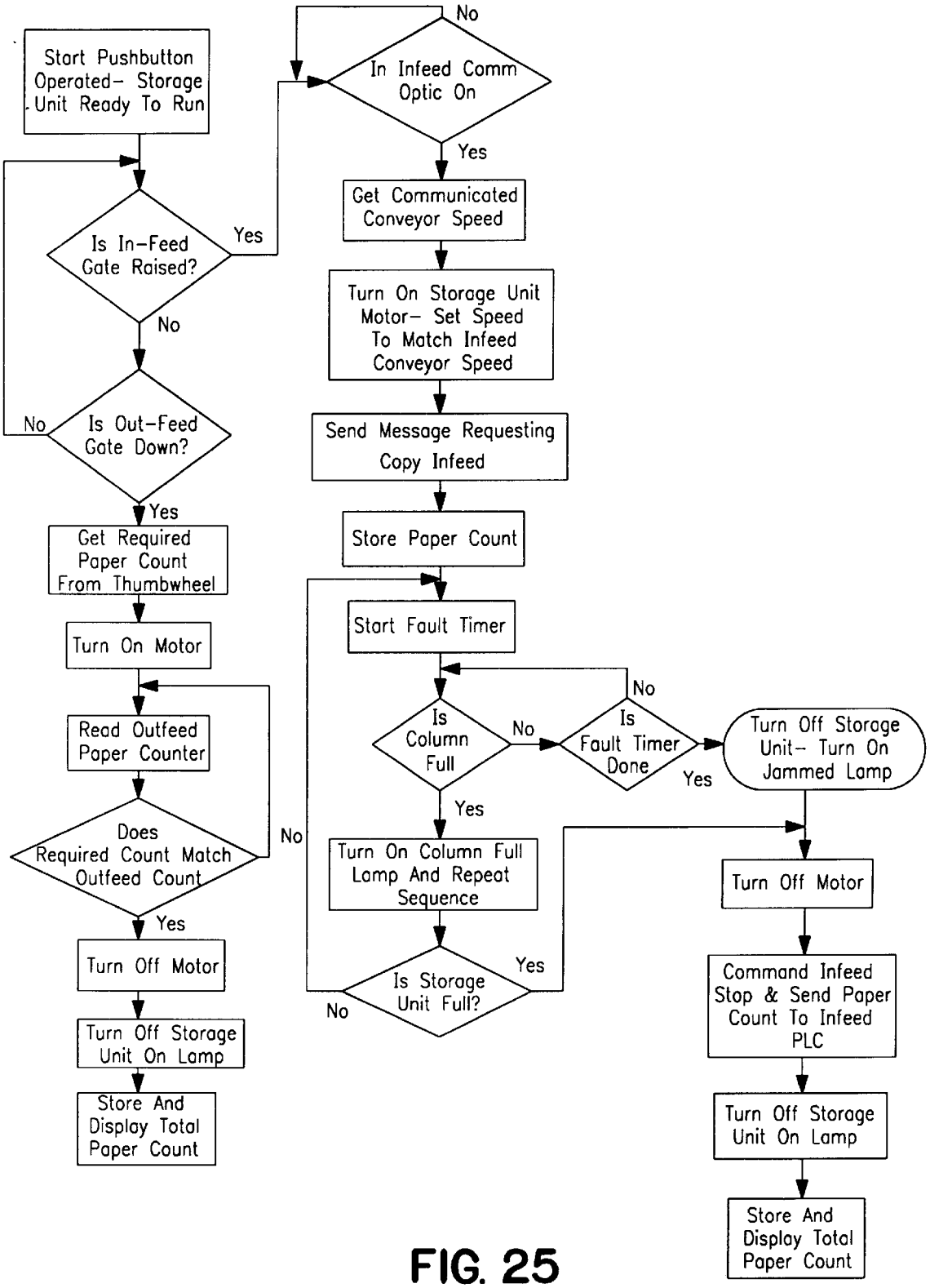
FIG. 25 is a flow diagram explaining the overall control of a storage device according to the present invention.
Figure 26:
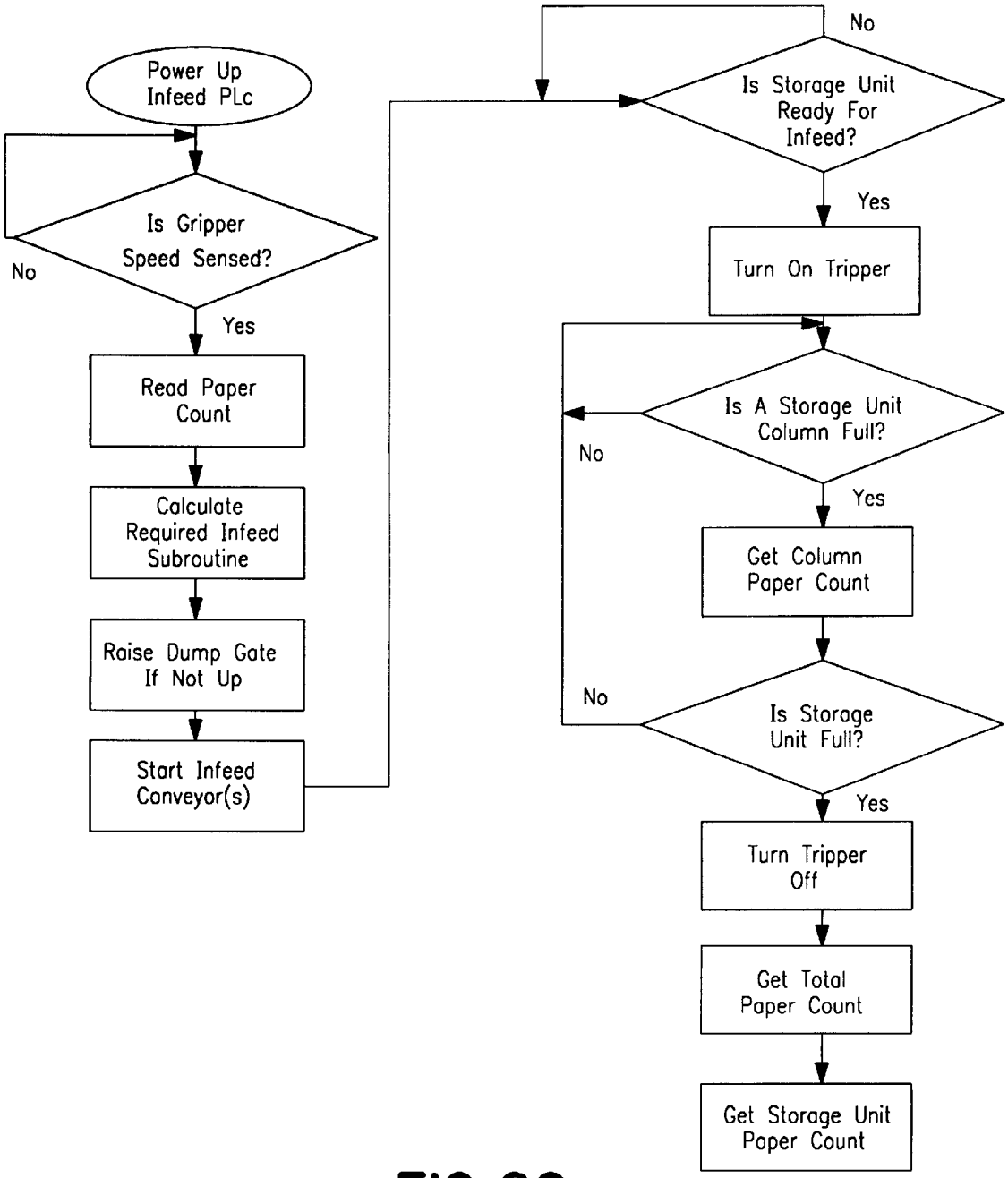
FIG. 26 is a flow diagram explaining the control of the infeed conveyor used in the subject system; and, FIG. 27 is a flow diagram explaining the steps involved in calculating infeed conveyor speeds and the number of infeed conveyors that will be fed by a main conveyor.

In operation, PLC 120 will control the infeed system as follows and as shown in flow diagrams in FIGS. 25 and 26. A storage device 10, which may be mounted on a truck 124, is positioned near the terminal end of infeed conveyor 106 and infeed gate 73 on storage unit 10 is raised and aligned with the terminal end of the infeed conveyor. The operator then pushes a start button on PLC 120. On power up, PLC 120 senses the speed of gripper conveyor 104 and waits for input from a user regarding the page count and gripper pitch. Based on this information, the infeed speed and the number of required drop points will be calculated and the proper conveyor speed will be sent to controller 95 and 114 via an optical communications link (not shown). Preferably, controllers 95 and 114 are variable frequency drive motor controllers. If the communications link is not established, the loading preparation will cease until communications are restored. Once communications are established, motor controller 95 and 114 are signaled to bring motors 94 and 110 up to the required speed. The speeds of the conveyors are monitored by using suitable encoders (not shown), and, if an underspeed condition occurs which could indicate a jam, dump gate 108 is lower to stop the flow of papers to the storage unit. Likewise, if communication between PLC 120 and motor controllers 95, 114 is lost, dump gate 108 will open and the loading process will cease.

Motor 110 drives the belts on infeed conveyor 106. Motor 94 causes belt 98 to turn and drive drive shaft 96. Drive shaft 96 is connected to the tail rollers 35 of the vertical columns 22, 24, 26, 28, and 30 and starts theses head rollers turning. Tail rollers 35 in a given column are all interconnected by diverter belts 52 and are all driven in unison by the rotation of drive shaft 96. Furthermore, head rollers 34 are connected to the tail rollers 35 by conveyor belts 38 and thus the rotation of the tail rollers is transmitted to the head rollers as well as to the diverter belt 50 on the front diverter 50. Flap hold down belts 62 are connected to head rollers 34 and also begin to turn. Lastly, transfers 76 are connected to return rollers 36 driven by belts 89 and these return rollers drive the transfers 76.

Once the infeed conveyor 106 and the conveyors 40 on the storage unit 10 are operating at a proper speed, the PLC signals tripper 118 to begin dropping papers from gripper conveyor 104 onto infeed conveyor 106 and the papers travel along infeed conveyor 106, over dump gate 108, through squarer 116, along infeed gate 73 and into storage unit 10 at input 72. From there, the papers travel from toward rear 20 of the storage unit toward diverter belt 52 of rear diverter unit 50. When the leading edge of the lapped stream of papers reaches the diverter belt, it is pulled between tail roller 35 and the diverter belt by the rotation of the tail roller. As can be appreciated from FIGS. 8 and 9, the elasticity of diverter belt 52 allows it to stretch away from tail roller 34 and the lapped stream to pass between the diverter belt and the tail roller, around the tail roller, and into the next lower flow path. The lapped stream continues to traverse the conveyor levels of first column 22 until it reaches the bottom level and approaches transfer 76 between columns 22 and 24. At this point the leading edge of the lapped stream is sensed by sensor 31. PLC 120 has been waiting for this signal, and if it had not been received within a specified time period, the PLC would have shut down the loading operation and signaled that a jam had occurred. PLC 120 waits for similar signals to be received from the other sensors 31 after other time periods to detect jam conditions at other locations. As the leading edge of the lapped stream passes onto transfer 76, the newspaper is engaged by vertical plastic slats 90 extending from roller chain 84 in channel sections 78 and is carried along the transfer. At the end of the transfer, plastic slats 90 push the lapped stream off of transfer 76 and onto the lowermost conveyor 40 of column 24. The papers travel up column 24 passing through the diverters on either end of the storage device as before. On the top level of column 24 the leading edge of the lapped stream triggers a second sensor 31 to indicate to the PLC that no jams have occurred. The lapped stream continues over a transfer 76 and works its way down column 26, up column 28 and down column 30 in a similar fashion. A final sensor in column 30 is located a set distance from the output 74 which is the end of the storage device. In addition to indicating that no jams have occurred, this sensor also tells the PLC that the storage unit is almost full and that the flow of papers thereto should be terminated. If the sensor is located a distance from output 74 equal to the length of infeed conveyor 106 and infeed gate 73 combined, the PLC can deactivate tripper 118 when a signal from this last sensor 31 is received and send the exact number of additional papers to the storage unit to fill it completely. A counter 126 provided at input 72 detects the exact number of papers received by the storage unit and sends this information to PLC 120.

To discharge papers from the storage unit, outfeed gate 75 is opened and the operator input the number of papers to be discharged into a control panel on storage unit motor controller 95 using a thumb wheel or similar mechanism. The motor controller will start motor 94 and begin discharging papers at an appropriate speed until a second counter 126 located at output 74 indicates that the required number of papers has been dispensed. The papers may be discharged onto the ground, into the arms of a waiting person, into a newspaper honor box, or into a newspaper delivery box as will be described hereafter. When all papers that need to be delivered have been delivered, the operator selects the purge function which causes all of the papers remaining in the device to be discharged.

As will be appreciated from the foregoing description, the subject storage unit operates on a first in, first out basis (FIFO). That is, the first newspaper that enters the unit is also the first one discharged. This is advantageous for several reasons. First, when operated as above, the papers always travel in the same direction with their fold edge 64 facing upstream. If the unit had to be reversed to discharge papers, the papers would be traveling with their free ends 66 forward and this could damage the papers and lead to possible jams. In addition, because the flow paths near input 72 empty as papers are dispensed, it is possible to feed old papers being returned by vendors into the input while new papers are being discharged. All of these papers can then be purged when the delivery truck is arrives at is final destination.

Figure 24:
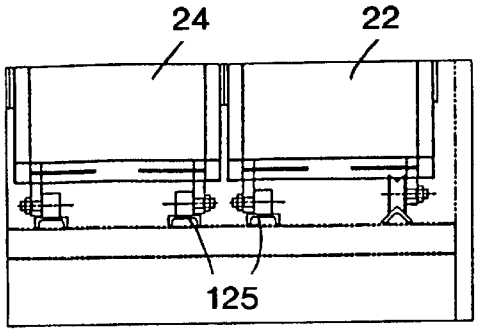
FIG. 24 is an elevational view of the bottom of the subject storage device showing wheels that support the subject device.
Figure 22:
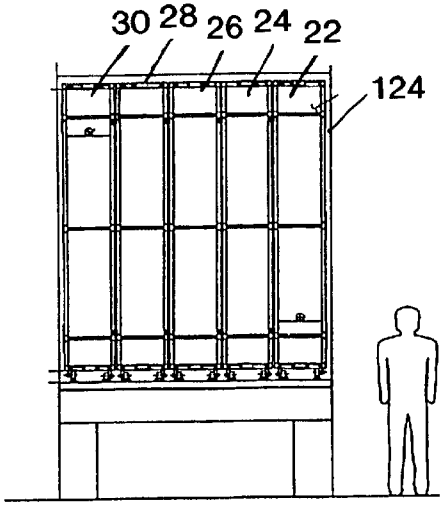
FIG. 22 is a rear elevational view of the truck and storage device shown in FIG. 19.

The storage unit may be produced in a variety of sizes. For example, a five column unit about 16 feet long can be used to store thousands of newspapers (the exact number depends on the thickness of the papers). Units of this size are appropriate for use as buffers in a newspaper printing operation or for holding a large number of papers and dispensing a given number of them at various locations. These units are preferably equipped with rollers or casters 128 as shown in FIG. 24 to allow the device to be rolled onto and off of trucks and/or moved around on the floor or ground. Smaller units can be used for other purposes, such as for newspaper delivery boxes as mentioned above. A newspaper delivery box is a coin-operated storage device which would replace the newspaper honor boxes now seen on many street comers. Instead of allowing an operator to select the number of papers to be dispensed, this number would be fixed at one, and the motor of the device would be operated only long enough to dispense this one paper. Alternately, the motor could be replaced with a crank mechanism for turning the drive shaft in the storage unit and the crank mechanism could be unlocked by the insertion of a coin. The unit could be filled with individual papers by hand, or connected to an outfeed gate on a truck equipped with a larger version of the storage unit and filled automatically from the larger unit.

The subject invention has been described herein in terms of a preferred embodiment, it being understood that many modifications to the invention will be obvious to those skilled in the art after a reading and understanding of the foregoing specification. All of these obvious modifications comprise a part of this patent to the extent that they are included within the scope of the claims appended hereto.

We claim:

1. A storage device for storing a plurality of flat, flexible objects having front faces and rear faces comprising:

a plurality of generally parallel conveyors each including upper and lower moveable belts for engaging the upper belts lower faces of the objects and having input rollers and output rollers, an input of each one of the plurality of convevors opposite an input of each adjacent conveyor;

a frame for supporting said plurality of conveyors; and at least one diverter for diverting said objects from the output end of a first one of said plurality of conveyors toward the input end of a second one of said plurality of conveyors, the diverter comprising a flexible member routed around a roller of a first one of the belt and routed around a roller of a third one of the belts to form a diverting flow path extending from the output of the first one of the conveyors, surrounding a roller of a second belt disposed between the first and second conveyvors, the path extending to the input of the second one of the conveyors.

2. The storage device of claim 1 wherein a turning radius of the output end is less than a thickness of the flat flexible object being stored.

3. The storage device of claim 1, wherein a turning radius of the output end is less than twelve inches.

4. A storage device according to claim 1 wherein said flexible member comprises a movable belt.

5. A storsge device according to claim 4 wherein said diverter movable belt is synchronized with said conveyor movable belts.

6. A storage device according to claim 4 wherein said diverter movable belt and said conveyor movable belts each have a modulus of elasticity, and wherein the modulus of elasticity of said diverter movable belt is less than the modulus of elasticity of said conveyor movable belts.

7. A storage device according to claim 4 wherein said objects have upstream edges and downstream edges and wherein said diverter includes protection means for protecting said downstream edges as said objects pass through said diverter.

8. A storage device for storing and dispensing a plurality of flat, flexible objects having front faces and rear faces comprising:

first, second and third conveyors each comprising at least one belt and a plurality of rollers for supporting said belt, said belt including a first portion traveling in a first direction and a second portion traveling in a second direction opposite to said first direction, said first, second and third conveyors being generally parallel and arranged in a vertical column such that said first portion of said first conveyor belt is adjacent to said first portion of said second conveyor belt and said second portion of said second conveyor belt is adjacent to said second portion of said third conveyor belt, said first and second conveyors defining a first flow path therebetween for said objects and having an input end and an output end, and said second and third conveyors defining a second flow path therebetween for said objects and having an input end and an output end;

at least one drive for driving said conveyors; and, a diverter forming a diverting flow path from said output end of said first flow path toward said input end of said second flow path.

wherein each of said conveyors includes a head end and a tail end and wherein said plurality of rollers for each of the conveyors comprises a head roller located at said head end and a tail roller located at said tail end of each conveyor, said diverter further comprising a belt supported by said first conveyor tail roller, said third conveyor tail roller, and at least one additional roller, the belt extending from the first conveyor tail roller, around objects exiting the output end of the first flow path, and to the third conveyor tail roller to form the diverting flow path.

9. A storage device according to claim 8 wherein said objects comprise newspapers.

10. The storage device of claim 8 wherein a turning radius of the head end is less than a thickness of the flat flexible object being stored and dispensed.

11. The storage device of claim 8, wherein a turning radius of the head end is less than twelve inches.

12. A storage device according to claim 8 wherein each of said conveyors includes a first end and a second end and wherein said plurality of rollers comprises a first end roller located at said first end and a second end roller located at said second end.

13. A storage device according to claim 12 wherein said diverter comprises a belt supported by said first conveyor second end roller, said third conveyor second end roller, and at least one additional roller.

14. A storage device according to claim 8 wherein said at least one additional roller comprises said second conveyor roller and the belt of the diverter is biased against the second conveyor head roller.

15. A storage device according to claim 14 wherein said second conveyor head and tail rollers are offset from said first and third conveyor head and tail rollers.

16. A storage device according to claim 15 including a second vertical column of conveyors substantially identical to said first column of conveyors, and a transfer conveyor for transferring the objects from the output end of said third flow path to the input end of one of the second column flow paths.

17. A storage device according to claim 15 wherein said fourth conveyor head and tail end rollers are generally aligned with said second conveyor end rollers.

18. A storage device according to claim 8 including:

a fourth conveyor in said vertical column comprising at least one belt and a plurality of rollers, including a head roller and a tail roller, for supporting said belt, said belt including a first portion adjacent to said third belt first portion and traveling in said first direction, and a second portion traveling in said second direction, wherein said third conveyor and said fourth conveyor define a third flow path therebetween;

a second diverter forming a diverting flow path from said output end of said second flow path toward said input end of said third flow path.

19. A storage device according to claim 18 wherein said second diverter comprises a belt supported by said second conveyor tail roller, said fourth conveyor tail roller, and at least one additional roller.

20. A storage device according to claim 19 wherein said at least one additional roller comprises said third conveyor head roller and the belt of the second diverter is biased against the third conveyor head roller.

21. A storage device according to claim 8 including a controller for controlling the loading of the device.

22. A storage device according to claim 21 wherein said controller also controls the discharge of the objects from the device.

* * * * *